US005863131A

United States Patent [19]

Nakamura

[11] Patent Number: 5,863,131

[45] Date of Patent: Jan. 26, 1999

[54] BAG

[75] Inventor: Toshio Nakamura, Osaka, Japan

[73] Assignee: Nakamura Seitai Co., Ltd., Osaka, Japan

[21] Appl. No.: 872,523

[22] Filed: Jun. 11, 1997

Related U.S. Application Data

[63] Continuation-in-part of PCT/JP96/02956, filed Oct. 11, 1996.

[30] Foreign Application Priority Data

Oct. 11, 1995 [JP] Japan ..... 7-263328
May 30, 1996 [JP] Japan ..... 8-136568

[51] Int. Cl.[6] ..... B65D 33/24; B65D 33/38

[52] U.S. Cl. ..... 383/89; 383/40; 383/83; 383/906

[58] Field of Search ..... 383/42, 40, 61, 383/82, 83, 85, 87, 88, 89, 906, 36, 70, 71, 77, 98, 99, 904

[56] References Cited

U.S. PATENT DOCUMENTS

| | | | |
|---|---|---|---|
| 1,183,962 | 5/1916 | Eggers | 383/904 X |
| 1,652,457 | 12/1927 | Reach | 383/89 X |
| 3,217,934 | 11/1965 | Schneider et al. | 383/89 X |
| 3,224,640 | 12/1965 | Schneider et al. | 383/89 X |
| 3,982,574 | 9/1976 | Bianchi et al. | 383/87 X |
| 3,998,304 | 12/1976 | Edgerton, Jr. et al. | 383/89 X |
| 4,408,643 | 10/1983 | Laske et al. | 383/89 X |

FOREIGN PATENT DOCUMENTS

| | | | |
|---|---|---|---|
| 1511004 | 10/1969 | Germany | 383/67 |
| 162247 | 7/1991 | Japan | 383/906 |
| 1088414 | 10/1967 | United Kingdom | 383/70 |

*Primary Examiner*—Jes F. Pascua
*Attorney, Agent, or Firm*—Jordan and Hamburg LLP

[57] ABSTRACT

A bag has a bag body made of two sheets and sealed throughout the periphery except at one place. A flattened, cylindrical inlet-outlet spout is connected at a base end thereof to the one place and extends at another end outwardly of the bag body. A pocket disposed on the bag body at the base end of the inlet-outlet spout, and is adapted to receive the inlet-outlet spout in an axially folded state. This bag is simple in construction and yet capable of reliably preventing leakage of contents.

3 Claims, 20 Drawing Sheets

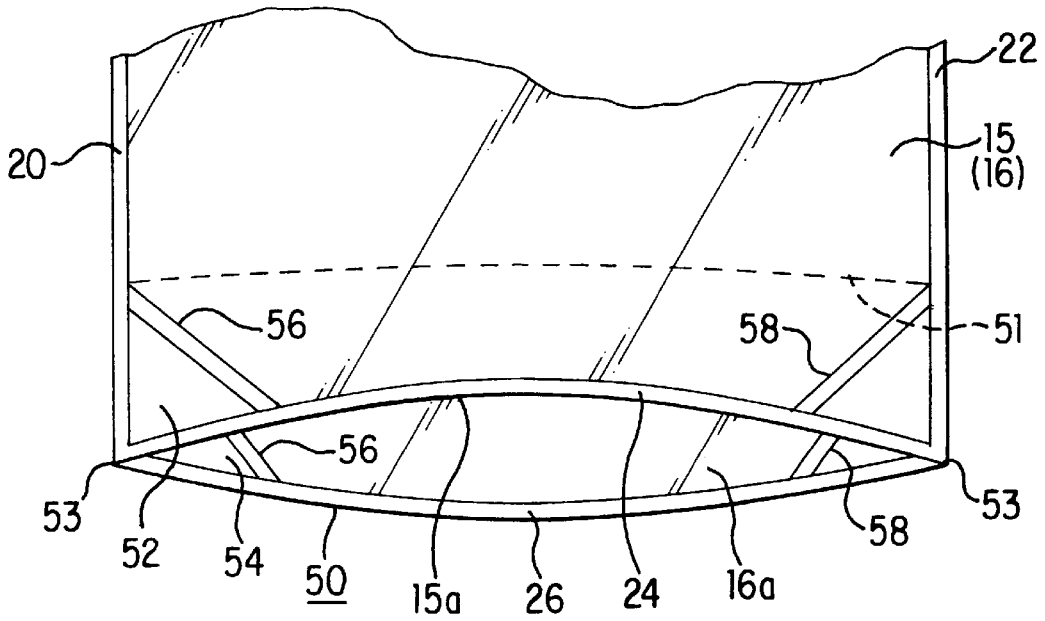
FIG. 2 [I]
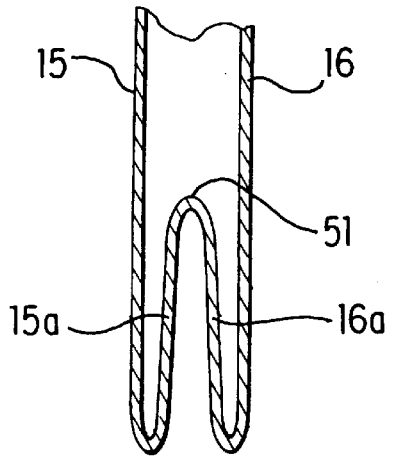
FIG. 2 [II]

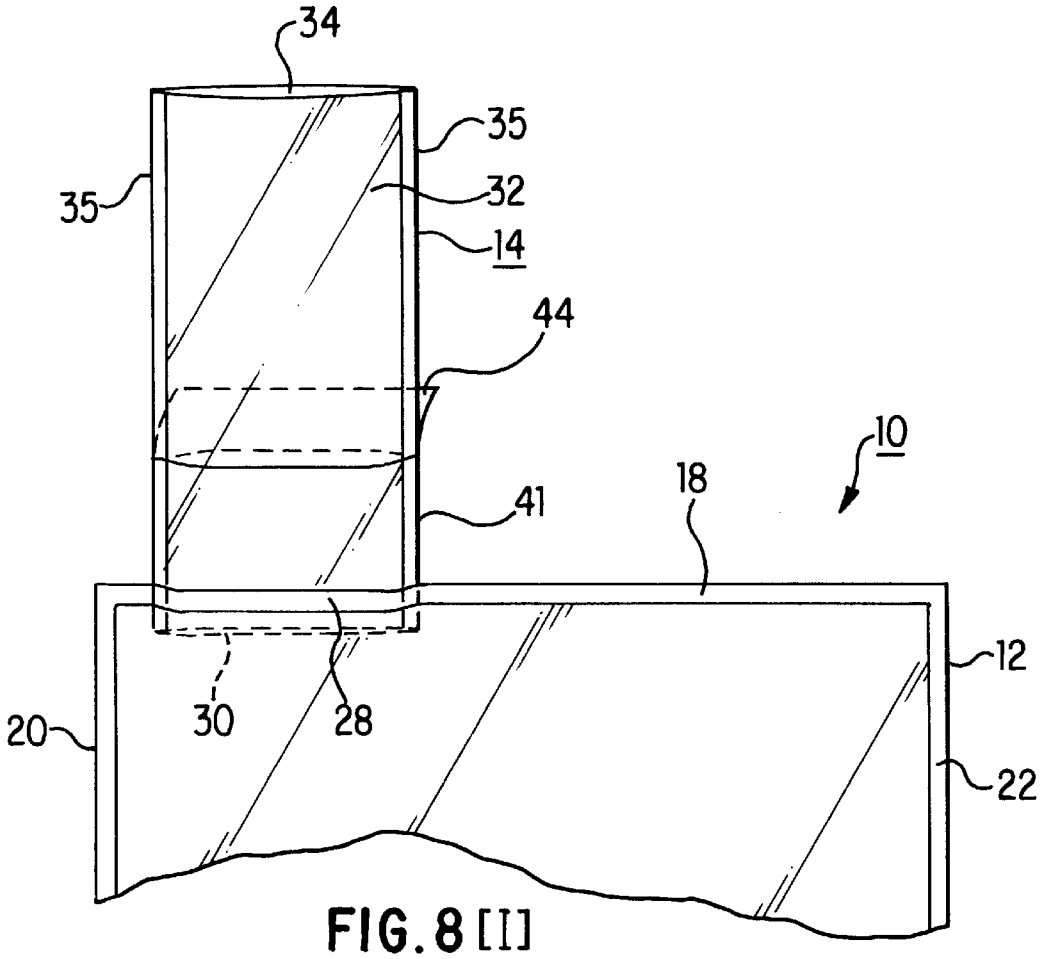
FIG. 8 [I]
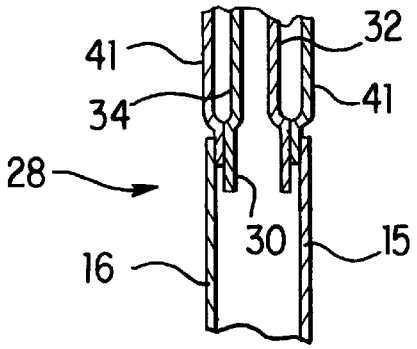
FIG. 8 [II]

BAG

REFERENCE TO RELATED APPLICATION

This is a continuation-in-part of International Application PCT/JP96/02956, filed Oct. 11, 1996.

BACKGROUND OF THE INVENTION

This invention relates to a bag, and particularly it relates to a bag suitable for storing and/or transporting liquid, powder, particles, gel-like substance, kneaded substance.

The applicant has previously made various inventions wherein for the purpose of preserving drink, two plastic sheets, front and back, are sealed together throughout the periphery thereof except at two places thereon, with inlet and outlet spouts in the form of flattened cylindrical bodies being attached thereto at said two places. However, in such a bag described above, it has been difficult to provide means for completely and easily preventing the liquid or the like, which is the content of the bag, from leaking out. This invention is intended to provide a bag which is free from said drawback.

SUMMARY OF THE INVENTION

The present invention comprises a bag body formed of two plastic sheets, front and back, sealed together throughout the periphery thereof except at one place thereon, a single inlet-outlet spout having one side thereof connected to said one place and the other side extending outwardly of the bag body in a plane of the bag body, and a pocket disposed on a front or back of a base in a vicinity of said bag body at said inlet-outlet spout, said pocket being adapted to store said inlet-outlet spout when the latter is axially folded.

In the invention, the periphery of the bag is opened only at one place to which the inlet-outlet spout is attached, the remainder of said periphery being closed. Therefore, in said remainder, there is no danger of the liquid or the like, which is the content, leaking out. Further, the single inlet-outlet spout which provides the sole port through which the content passes is axially foldable to reliably prevent the liquid from flowing axially in the inlet-outlet spout, particularly the liquid inside the bag body from leaking out. Furthermore, in such folded state which provides reliable prevention of leakage of the liquid, the inlet-outlet spout can be inserted into the pocket, so that said folded state can be reliably retained and hence leakage of the liquid or the like can be more reliably prevented.

The present invention further provides the bag described above including a lid for covering said pocket and means for retaining said lid in a state in which it covers said pocket.

With the arrangement thus made, the folded inlet-outlet spout can be reliably prevented from coming out of the pocket to become unfolded, so that the liquid or the like is prevented from leaking out.

The present invention further provides the above bag wherein said lid has means for holding said inlet-outlet spout in a squeezed state. Thus, since the inlet-outlet spout can be held in the squeezed state, the liquid or the like in the bag can be released little by little (so-called thin stream delivery). Further, by increasing a degree of the squeezing, it is possible to temporarily cut the delivery of the liquid or the like from the bag.

The present invention further provides the above bag, wherein said holding means is a pair of engaging means provided on opposite sides of said lid, the arrangement being such that said lid holds said inlet-outlet spout in its rolled and squeezed state by engagement of said pair of engaging means.

The present invention further provides the above bag, wherein said holding means is an insertion port formed in said lid, so that by inserting said inlet-outlet spout, in its squeezed state, into said insertion port, said squeezed state can be held.

Thus, the inlet-outlet spout can be held in its squeezed state by simple mean, thereby making it possible to deliver the liquid or the like from the bag in a thin stream or stop the stream temporarily during the delivery.

In addition, the retaining means and the engaging means of the invention are not limited to a planar fastener described in the following embodiment, as it is possible to employ a pair of string-like members to be knotted together, a snap fastener, an engaging projection and recess or the like.

BRIEF DESCRIPTION OF THE DRAWINGS

FIG. 2 (I) is a perspective view showing the bottom of said bag and FIG. 2 (II) is a sectional view thereof;

FIG. 8 (I) is a perspective view showing another embodiment of the invention, and FIG. 8 (II) is a sectional view thereof;

DETAILED DESCRIPTION OF THE INVENTION

Figure 1:
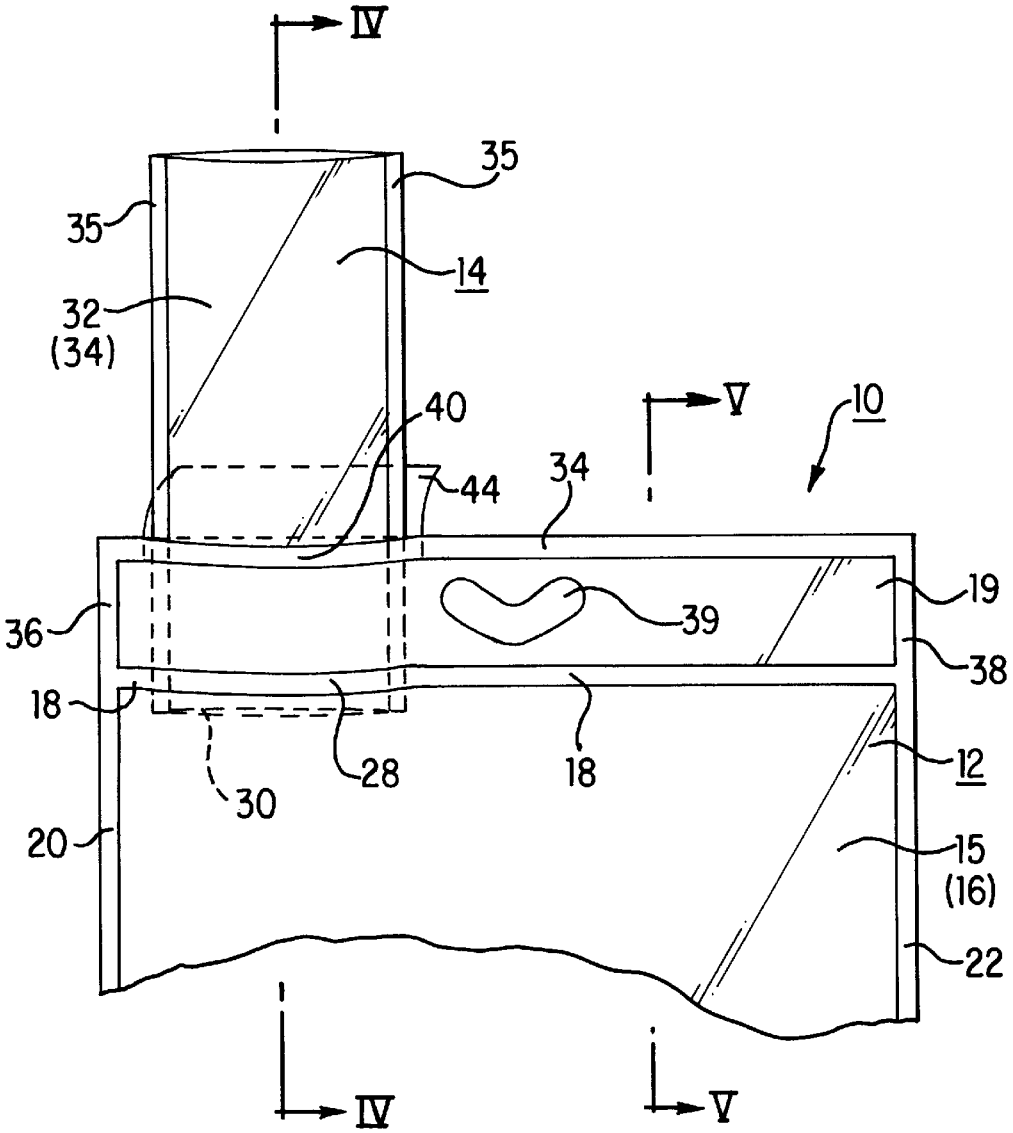
FIG. 1 is a perspective view showing the top of a bag according to an embodiment of the present invention.
Figure 3:
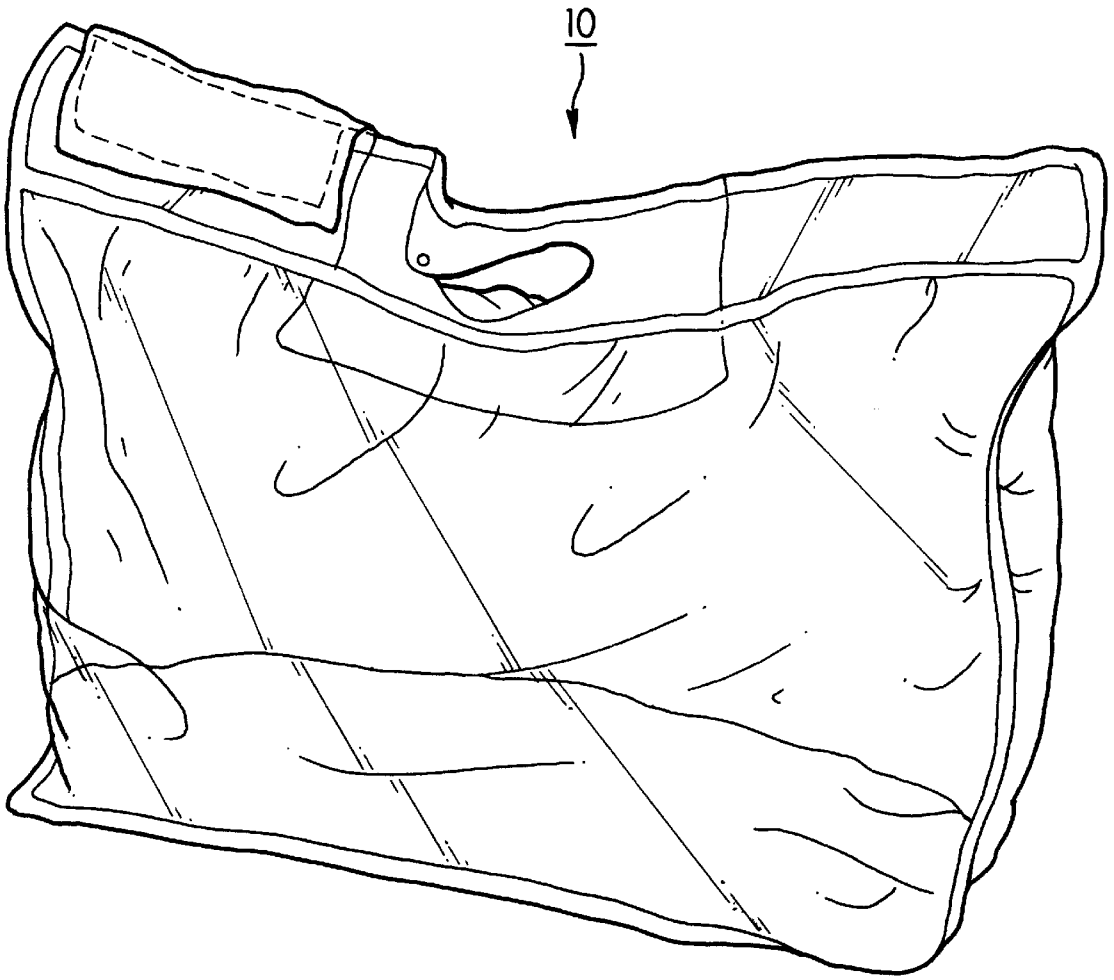
FIG. 3 is a perspective view of the bag with water stored therein.
Figure 4:
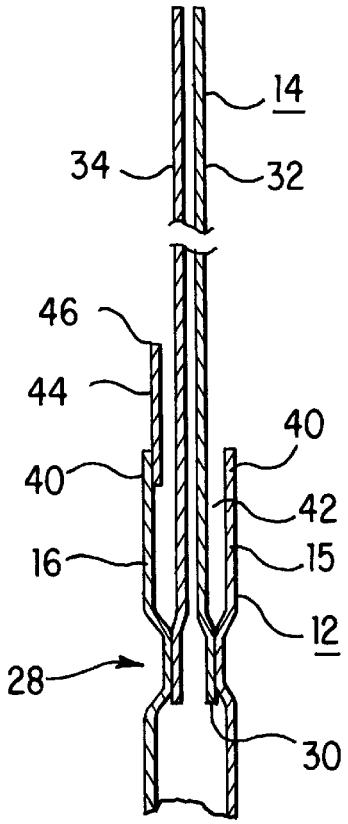
FIG. 4 is a sectional view taken along the line IV—IV in FIG. 1.
Figure 5:
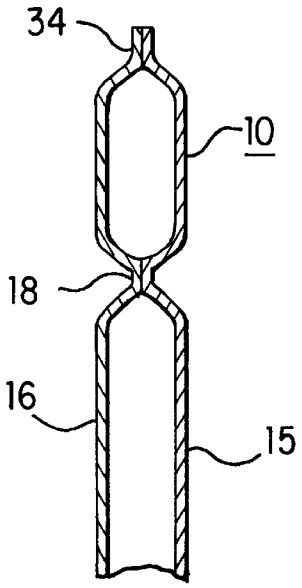
FIG. 5 is a sectional view taken along the line V—V in FIG. 1.

FIGS. 1 through 6 show an embodiment of the invention. The numeral 10 denotes a bag according to this invention, comprising a bag body 12 and a single inlet-outlet spout 14. The bag body 12 is formed of two sheets 15 and 16, front and back, in the form of plastic films, welded together on their four sides. That is, the resulting welds are all linear, being an upper weld 18, a left-hand side weld 20, a right-hand side weld 22, and bottom welds 24 and 26. In addition, the bag body 12 includes a portion extending downward from the upper weld 18. And in the upper weld 18, the front and back sheets 15 and 16 are welded together; however, at a segment 28 located somewhat leftward from the middle in FIG. 1, the front and back sheets 15 and 16 are not welded together although the segment 28 lies on an extension of the upper weld 18.

The inlet-outlet spout 14 is in the form of a flattened cylindrical body of plastic film and serves to pour in and out contents of the bag 10. A lower end 30 thereof is located somewhat below the segment 28 on an extension of the upper weld 18. The front and back sheets 32 and 34 which form said flattened cylindrical body are welded together on opposite sides 35. However, said flattened cylindrical body may be a cylindrical body having no welds on opposite sides. And said flattened cylindrical body is attached to the bag body 12 such that at the segment 28, the front sheet 32 in FIG. 1 showing the inlet-outlet spout is welded to the front sheet 15 constituting the bag body 12, while the back sheet 34 constituting the inlet-outlet spout is welded to the back sheet 16 constituting the bag body 12. Thus, the inlet-outlet spout 14 is fixed to the bag body 12 by welding. Therefore, the inner space of the bag body 12 communicates with the outside only through the lower end 30 of the inlet-outlet spout 14, the bag body 12 being completely closed in the other or remaining portions.

The front and back sheets 15 and 16 extend above the upper weld 18 to form an extension 19. At an upper end 34 and right- and left-side regions 38 and 36 of said extension, the front and back sheets 15 and 16 are welded together. However, at a segment 40 on the left-hand side of the figure which lies on an extension of the upper weld 34, the front and back sheets 15 and 16 are not welded together. The segment 40 is axially aligned with the segment 28 on the extension of the upper weld 18. And the inlet-outlet spout 14 in the form of the flattened cylindrical body passes through the place 40. In this embodiment, at the segment 40, the front and back sheets 15 and 16 are not welded together. The numeral 39 denotes an opening serving the function of a carrying handle for a user to carry the bag by hand with his fingers passed therethrough.

The space defined between the front sheet 15 and the inlet-outlet spout 14 serves as a pocket 42 for receiving the inlet-outlet spout in a folded state to be later described. Welded to the segment 40 at the back sheet 16 is a lid 44 for closing the pocket 42.

Figure 6:
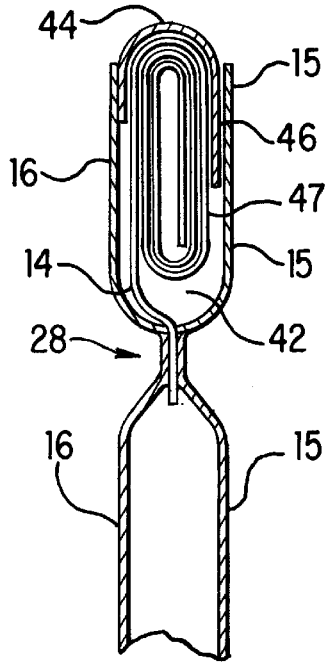
FIG. 6 is a sectional view showing an inlet-outlet spout folded and received in a pocket.

After liquid or the like is poured into the bag body 12 in the state shown in FIG. 1, the inlet-outlet spout 14 is axially folded and received in the pocket 42. And the lid 44 is put over the pocket 42, with its free end 46 put between the folded body 47 of the inlet-outlet spout 14 and the front sheet 15 constituting the bag body 12 and thereby is held in place (FIG. 6). Because of such arrangement, the folded state of the folded body 47 is maintained. Therefore, even if the liquid or the like stored in the bag tends to leak, it is impossible for the liquid to pass through the inlet-outlet spout held in such a folded state. Further, the ends of the folded body 47 are shown arcuate, but in reality they are bent zigzag, such zigzag ends preventing passage of water or the like. As for the way of folding the inlet-outlet spout 14, besides the illustrated roll form, it may be folded in bellows form. Alternatively, first it may be folded in two, then this folded body may be folded in two again, and finally this folded body may be folded in two again.

Now, referring to FIG. 2, the bottom 50 of the bag body 12 will now be described. The bottom 50 is gazette-wise folded. That is, the front and back sheets 15 and 16 are turned up toward each other. The turnups 15*a* and 16*a* are continuous with each other at the top 51. In this manner, two folded portions 52 and 54 are formed. These folded portions 52 and 54 are each formed with oblique welds 56 and 58, whereby the sheets 15 and 15*a* are welded together and so are the sheets 16 and 16*a*. This prevents the liquid in the container from moving across the welds 56 and 58 and reaching the corners 53 of the bottom. Because of such bottom construction, when water is stored, the bottom 50 spreads and the bag assumes the form shown in the perspective view of FIG. 3.

Figure 7:
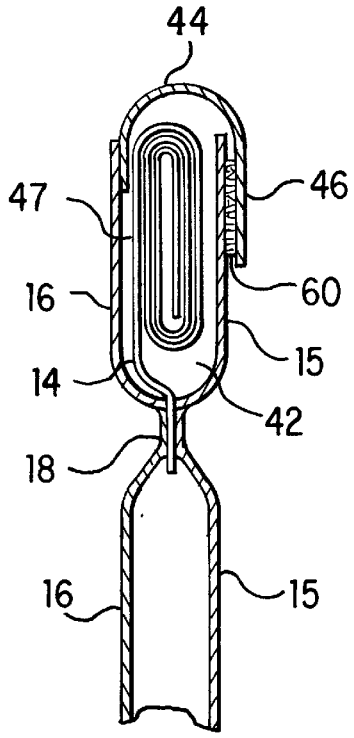
FIG. 7 is a sectional view showing a modification of the embodiment of FIG. 6.

FIG. 7 shows another embodiment of the invention, wherein the free end of the lid 46 for the pocket abuts against the outer surface of the front sheet 15. Male and female members 60 of a planar fastener are attached to the inner surface of the lid 46 and the outer surface of the front sheet 15, so that the engagement of the two members holds the pocket 42 closed by the lid 44.

In the above embodiment, the extension 19 of substantially the same width as that of the upper weld 18 which defines the upper edge of the bag 12 has been formed on said upper weld and its upper end 34 seems as if it were the upper end of the bag body. An alternative arrangement is shown in FIG. 8, wherein the cylindrical pocket 41 projects upward from an upper weld 18 defining the bag body 12, and the inlet-outlet spout 14 extending inside the pocket 41 is folded and received in the pocket. The way the inlet-outlet spout 14 is attached to the bag body 12 is the same as in FIG. 1. In the above embodiment, the bag body is shown flat, formed of two sheets, front and back, and provided with gussets in the bottom. However, another arrangement in which gussets are not provided in the bottom, or gussets are provided in the bottom and the sides of the bag body, is also within the scope of the present invention.

In the case of the embodiment shown in FIGS. 1 through 6, the retaining means for the lid 44 is of nipping construction utilizing the folded body 47 of the inlet-outlet spout and the front sheet 15 of the bag body, as clearly shown in FIG. 6, and in the case of the embodiment shown in FIG. 7, it is the planar fastener 60. For the retaining construction, any desired form, such as an adhesive tape, clip or the like, may be employed.

FIGS. 9 through 12 show a further embodiment of the invention. This embodiment has many points in common with the one shown in FIG. 1, differing only in the construction of the lid 44. A lid 44*a* extends upward a little longer than in the embodiment of FIG. 1. And the opposite sides of the lid 44*a* are cut as at 62 in opposed semicircular form. This results in forming a vertically extending narrower portion 63 in the upper portion of the lid 44*a*. The left-hand side region 64 of the narrower portion 63 is formed as its is folded back, as shown. The folded-back region 64 has the male member 65 of a planar fastener. Further, the right-hand side region 66 of the narrower portion 63 has the female member 67 of the planar fastener. The distance from the upper end 34 of a the extension 19 of the bag body 12 to the upper end of the lid 44*a* substantially corresponds to the distance between the upper end 34 and the upper weld 18 of the bag body 12. The upper surface of the region 28 which lies on the same horizontal line as does the upper weld 18, i.e., the surface of the bag has the female member 68 of a planar fastener attached thereto on the left-hand side and the male member 69 on the right-hand side.

Figure 11:
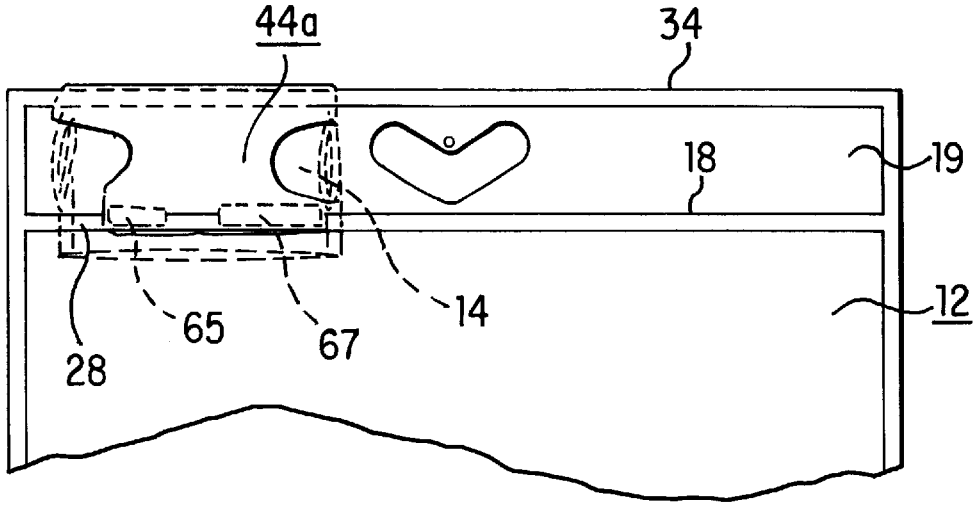
FIG. 11 is a perspective view showing a lid of the embodiment of FIG. 9 folded and placed on the bag body.

Thus, when the lid 44*a* is folded back around its base to overlie the bag body 12, the male and female members 65 and 67 of the planar fastener overlie the female and male members 68 and 69 of the planar fastener disposed in the region 28, the engagement between these female and male members holds the pocket 42 closed by the lid 44*a* (FIG. 11). That is, in this embodiment, the members 65, 67, 68, 69 constituting planar fasteners providing retaining means.

Figure 12:
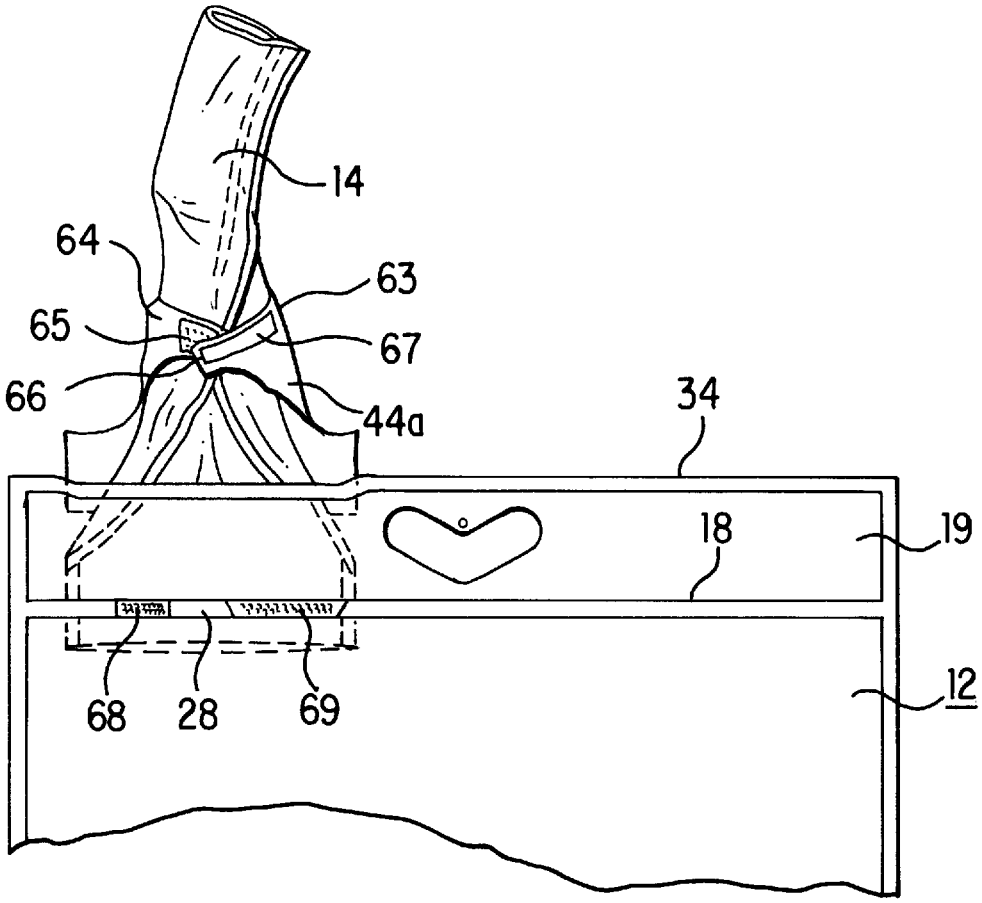
FIG. 12 is a perspective view showing an inlet-outlet spout of FIG. 9 in a straightened and squeezed state.

When its is desired to discharge the liquid or the like from the bag 12, the rolled inlet-outlet spout will be straightened to position its free end at a lower level for discharge of the content. In this case, as shown in FIG. 12, the straightened inlet-outlet spout 14 is squeezed, or constricted, with the narrower portion 63 of the lid 44*a* wound therearound. Restriction means for the inlet-outlet spout 14 are formed when, the right-hand side region 66 of the narrower portion 63 is folded toward the front to overlie the left-hand side region 64, whereby the male and female members 65 and 67 of the planar fastener abut against each other; thus, the engagement of the members 65 and 67 holds the narrower portion 63 in a wound state. In this manner, the inlet-outlet spout 14 is maintained in its squeezed state, so that the liquid or the like in the bag will never be discharged in large quantity through the inlet-outlet spout, and instead it will be discharged in the manner of thin stream delivery which allows only a small amount to be discharged. Since the male and female members 65 and 67 have some length widthwise of the lid 44*a*, the position where they abut against each other can be relatively changed, whereby the diameter of the roll of the narrower portion 63 can be changed. If this diameter is minimized, it is possible to temporarily cut the delivery of the liquid or the like from the bag.

The male and female members of the planar fastener is this embodiment may be changed for fresh ones.

Figure 9:
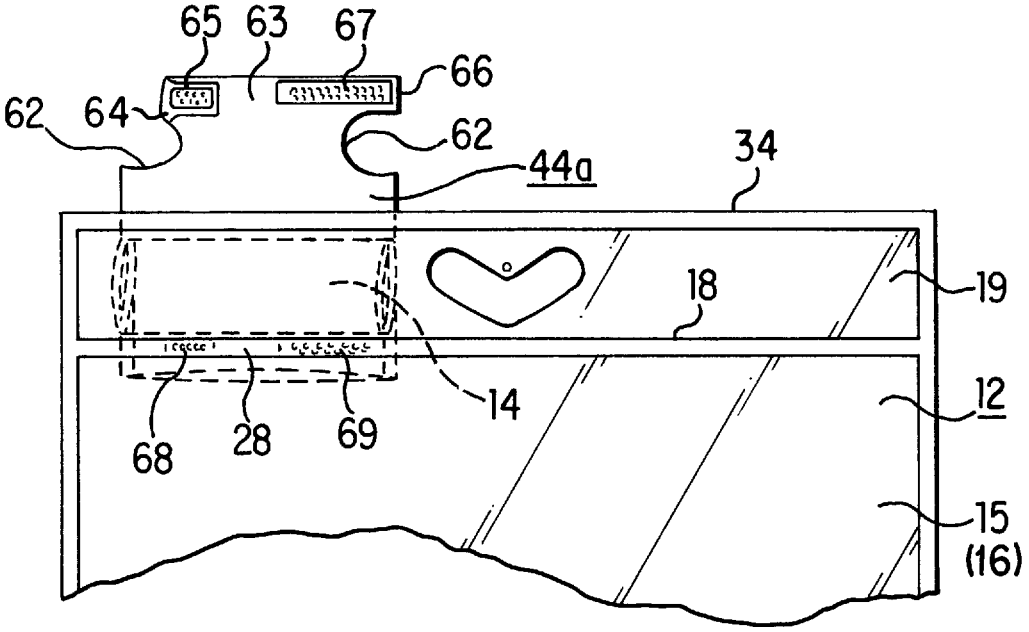
FIG. 9 is a perspective view of another embodiment of the present invention.
Figure 10:
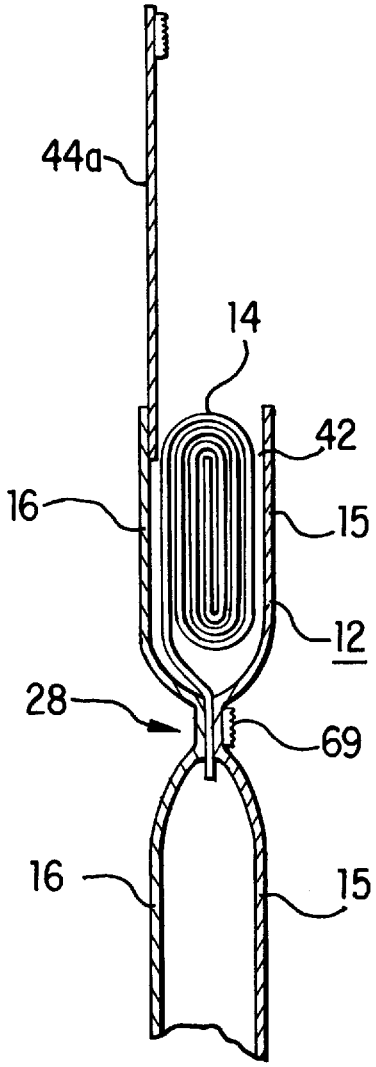
FIG. 10 is a sectional view showing a portion of the embodiment of FIG. 9.
Figure 13:
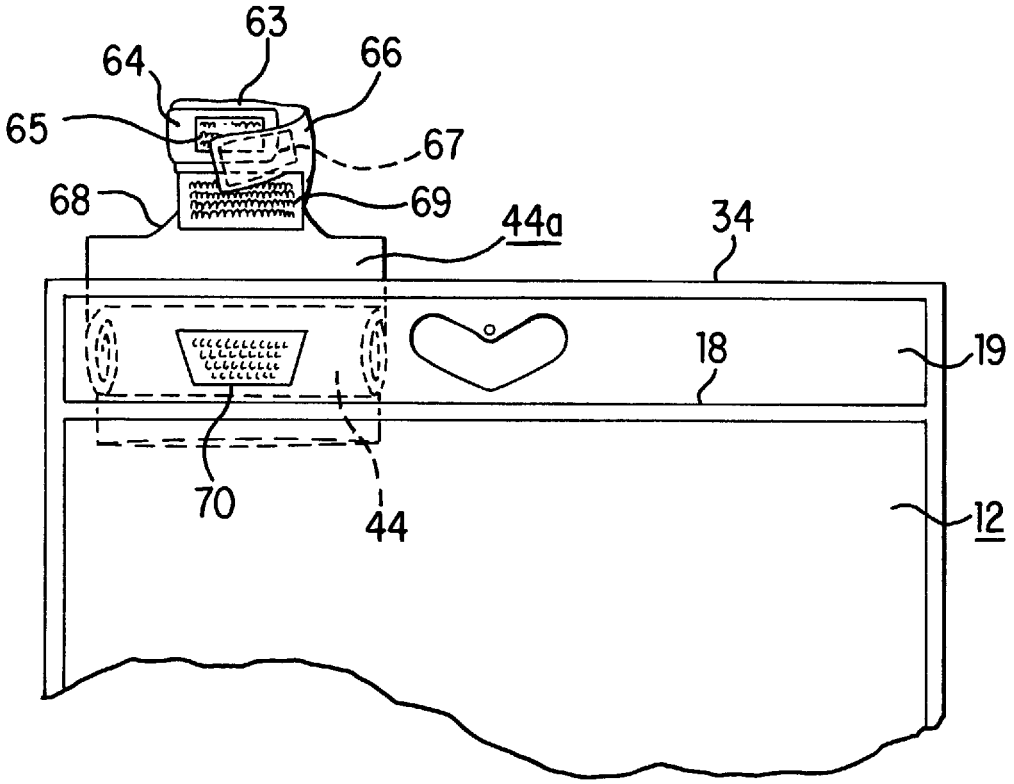
FIG. 13 is a perspective view similar to FIG. 9, showing a modification of the embodiment of FIG. 9.
Figure 14:
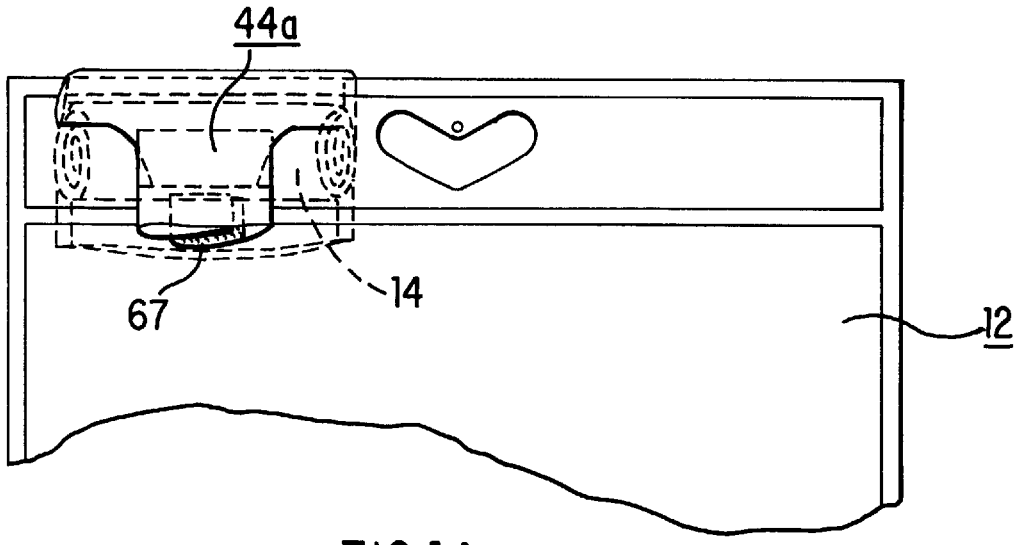
FIG. 14 is a perspective view showing a lid of FIG. 13 folded on the bag body.
Figure 15:
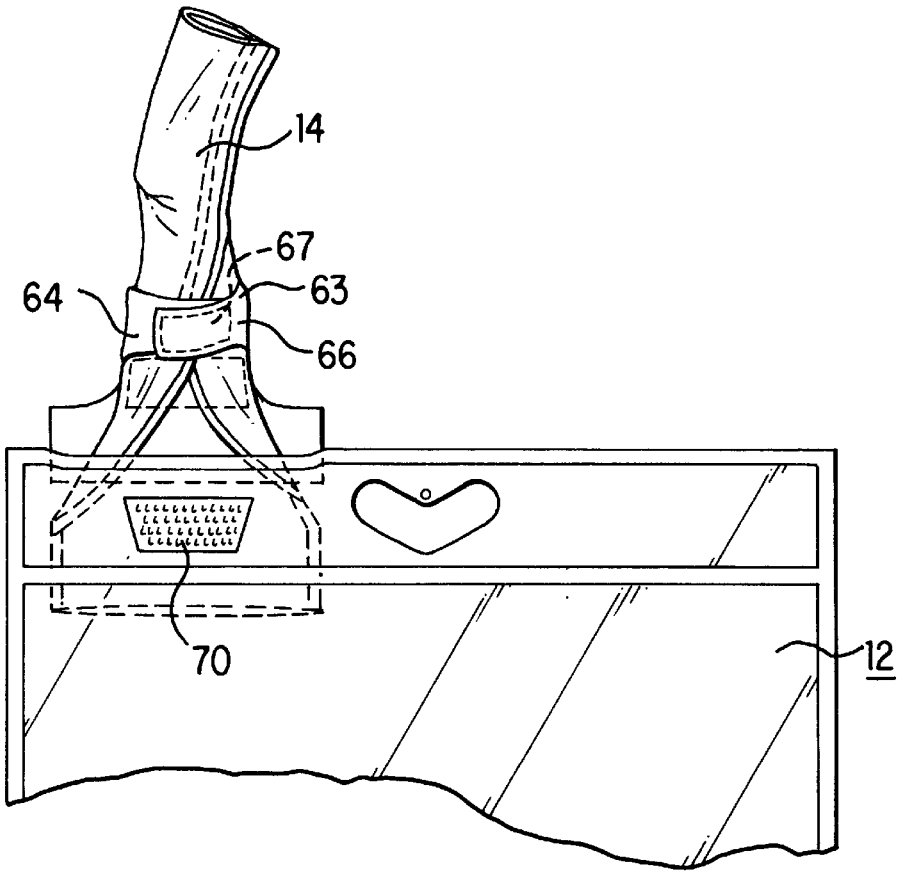
FIG. 15 is a perspective view similar to FIG. 12, showing the inlet-outlet spout of the preceding figure held in a straightened and squeezed state.

FIGS. 13 through is show a modification of the embodiment of FIG. 9. The difference from the embodiment of FIG. 9 resides in the manner of attaching the members of a planar fastener. That is, as in the case of the embodiment of FIG. 9, the female and male members 65 and 67 of a planar fastener are provided on the left and right-hand side regions of the narrower portion 63 in the front end of the lid 44*a*. That is, the back of the left-hand side region 64 is provided with the male member 65 and the front of the right-hand side region 66 with the female member 67. However, unlike the embodiment of FIG. 9, in this case, the constricted region 68 of the lid 44*a* is provided with a relatively large female member 69. And the region of the bag body 12 which will be opposed to the female member 69 when the lid 44 is folded, i.e., the region of the bag body 12 intermediate between the upper weld 18 of the bag body 12 and the upper end 34 of the extension 19, has the male member 70 of the planar fastener attached thereto. As for the means for retaining the lid 44*a* when the latter is closed, the female and male members 69 and 70 act as such means (FIG. 14). On the other hand, the action for holding the straightened inlet-outlet spout 14 in its squeezed state is achieved by the first-mentioned male and female members 65 and 67 (FIG. 15).

Thus, this modification differs from the embodiment of FIG. 9 in that the means for retaining the lid 44*a* in its closed state is separate from the restriction means for squeezing the straightened inlet-outlet spout.

Figure 16:
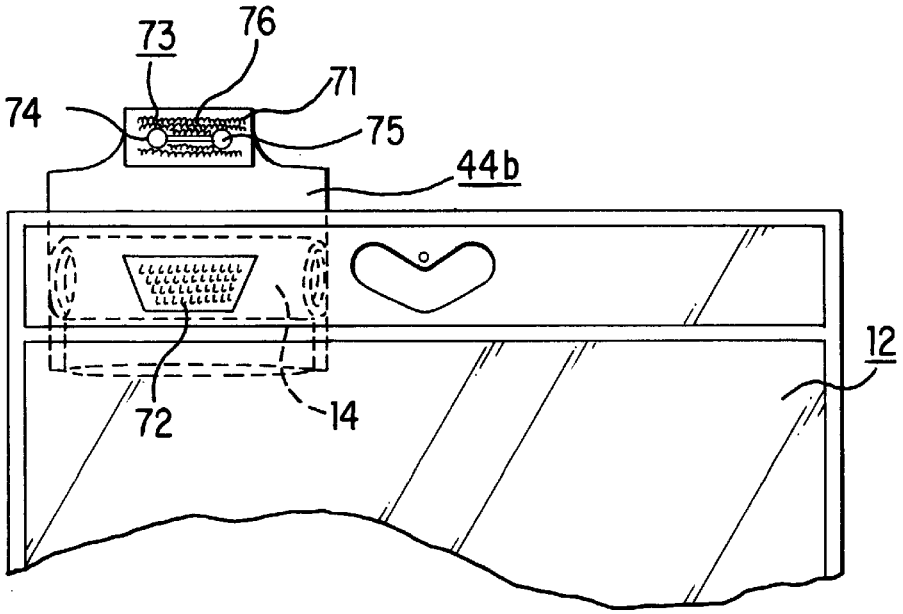
FIG. 16 is a perspective view similar to FIG. 9, showing a modification of the embodiment of FIG. 9.
Figure 17:
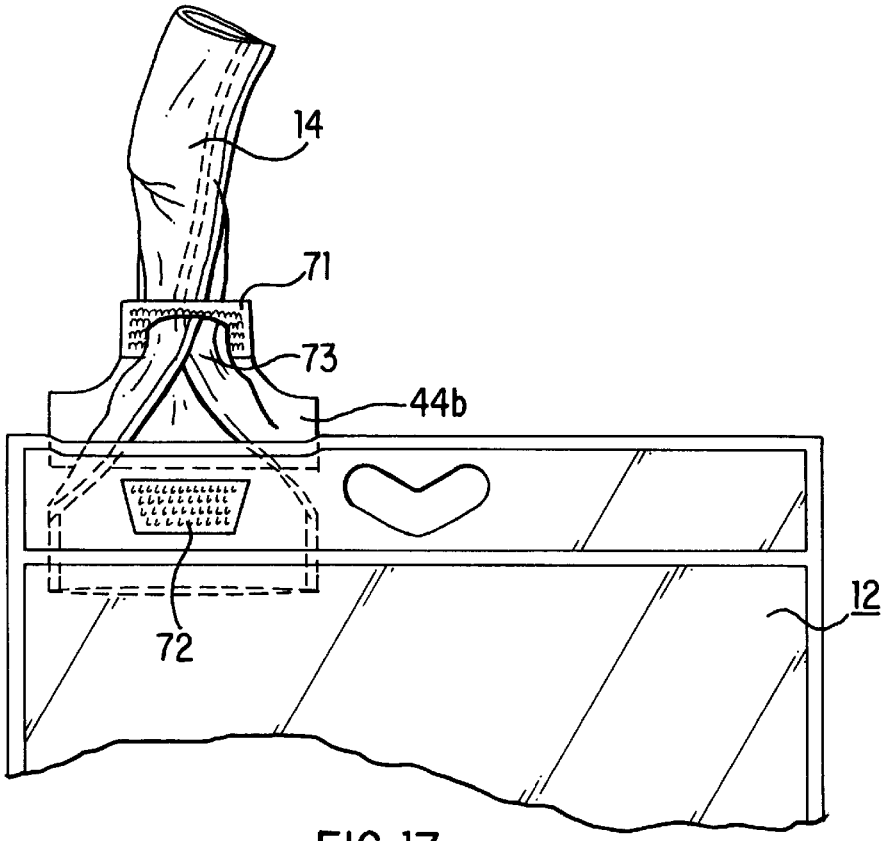
FIG. 17 is a perspective view similar to FIG. 12, wherein the inlet-outlet spout in the preceding figure is shown in a straightened and squeezed state.

FIGS. 16 and 17 show another modification of the embodiment of FIG. 9. In this case, a front end of a lid 44*b* is provided with the female member 71 of a planar fastener and its the region of the bag body 12 which will be opposed to the female member 71 when the lid 44*b* is folded onto the bag body 12 is provided with the male member 72. The female member 71 is formed with a hole 73. The hole 73 comprises right and left circular ports 75 and 74 and a linear cut 76 connecting them together forming restriction means for the inlet-outlet spout 14".

The inlet-outlet spout 14 in its straightened state is inserted into the hole 73. Thereby, the inlet-outlet spout 14 is squeezed by the hole 73. The provision of the right and left circular ports 75 and 74 makes it easier for the hole 73 to spread and hence facilitates the insertion of the inlet-outlet spout 14. Furthermore, the provision of the linear cut 76 between the two circular ports 74 and 75 enables the inlet-outlet spout 14 to be pressed hard at this place to assume an effective squeezed state.

In the state in which the inlet-outlet spout 14 is folded and received in the pocket 42, and when the lid 44*b* is closed, the female and male members 71 and 72 serve as the means for retaining the lid 44*b* in its closed state.

As a modification of this embodiment, though omitted from illustration, the following arrangement may be made.

A planar fastener is longitudinally used (i.e., the longer side of the rectangle extends vertically) and the hole also extends in the direction of the longer sides.

The longitudinal use of a planar fastener provides a greater resistance to shearing force (dislocating force) in the longitudinal direction (vertically of the bag). If the bag storing water is subjected to a shock acting in the direction to nip the front and rear walls, the longitudinally folded inlet-outlet spout will be subjected to a shock which tends to spread it longitudinally. That is, a longitudinal dislocating force is impulsively applied between the female and male members of the planar fastener. In such case, the longitudinal use of the planar fastener enables all the longer sides of the planar fastener to resist the longitudinal dislocating force. Thus, it is possible to prevent the liquid from spilling.

Further, since the hole is located in the direction of the longer sides of the planar fastener, i.e., vertically of the bag, the following merit is obtained: The inlet-outlet spout is in the form of a flattened cylindrical body and usually is horizontally directed. If the hole is longitudinally provided, then when the flattened inlet-outlet spout is to be passed through this hole, it is necessary that the horizontal inlet-outlet spout be twisted so that its surface is longitudinally directed, and then it be passed through the longitudinally extending hole. Thus, a 90° twist is inevitably applied to the inlet-outlet spout. Therefore, this provides a great resistance to the water tending to be discharged through the inlet-outlet spout. Therefore, When it is desired to effect thin stream delivery by spreading the inlet-outlet spout and passing it through this hole, the degree of thin stream delivery is increased.

Figure 18:
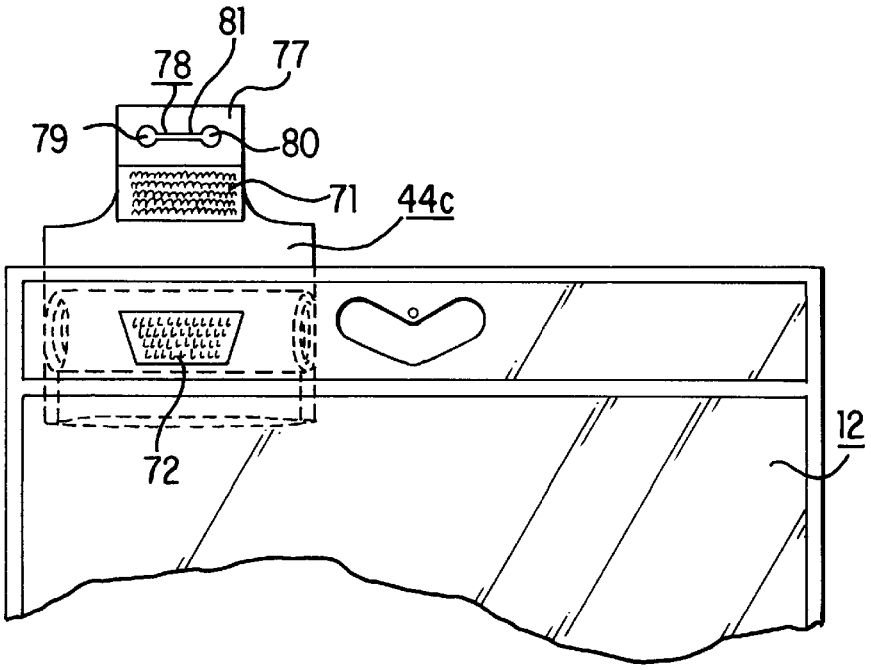
FIG. 18 is a perspective view similar to FIG. 16, showing a modification of the embodiment of FIG. 16.
Figure 19:
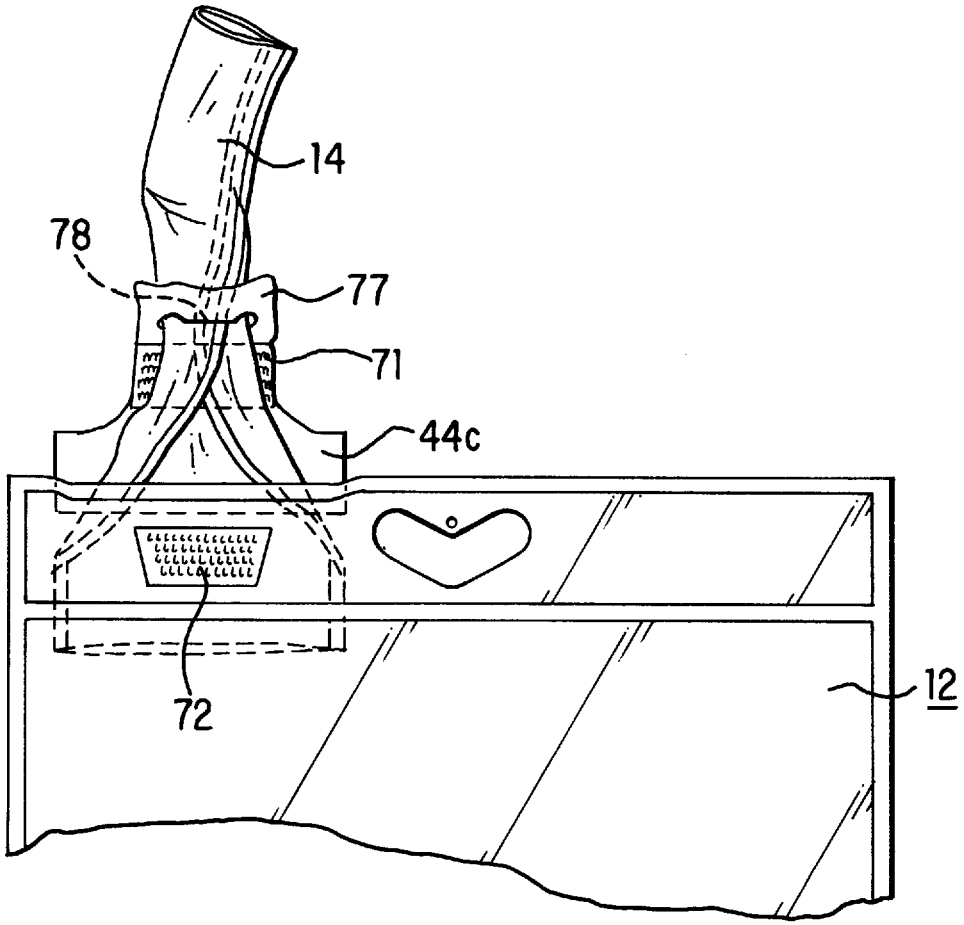
FIG. 19 is a perspective view similar to FIG. 12, wherein the inlet-outlet spout in the preceding figure is shown in a straightened and squeezed state.

FIGS. 18 and 19 show a modification of FIGS. 16 and 17. In this case, a lid 44*c* is extended beyond the female member 71, forming a surplus portion 77. A hole 78 is formed in this surplus portion 77. The hole 78, like the hole 73 of FIG. 16, has circular holes 79 and 80 at its opposite sides, and a linear cut 81 which connects them together to form restriction means for the inlet-output spout 14".

In this case, acting as the means for retaining the lid 44*c* in its closed state are the male and female members 71 and 72 of planar fastener. However, the female member 71 is not provided with a hole and the surplus portion 77 thereabove is provided with the hole 78, so that when the straightened inlet-outlet spout 14 is to be squeezed, it is passed through the hole 78. Thus, in this embodiment, the means for holding the lid 44*c* in its closed state and the means for squeezing the inlet-outlet spout are separate from each other.

Figure 20:
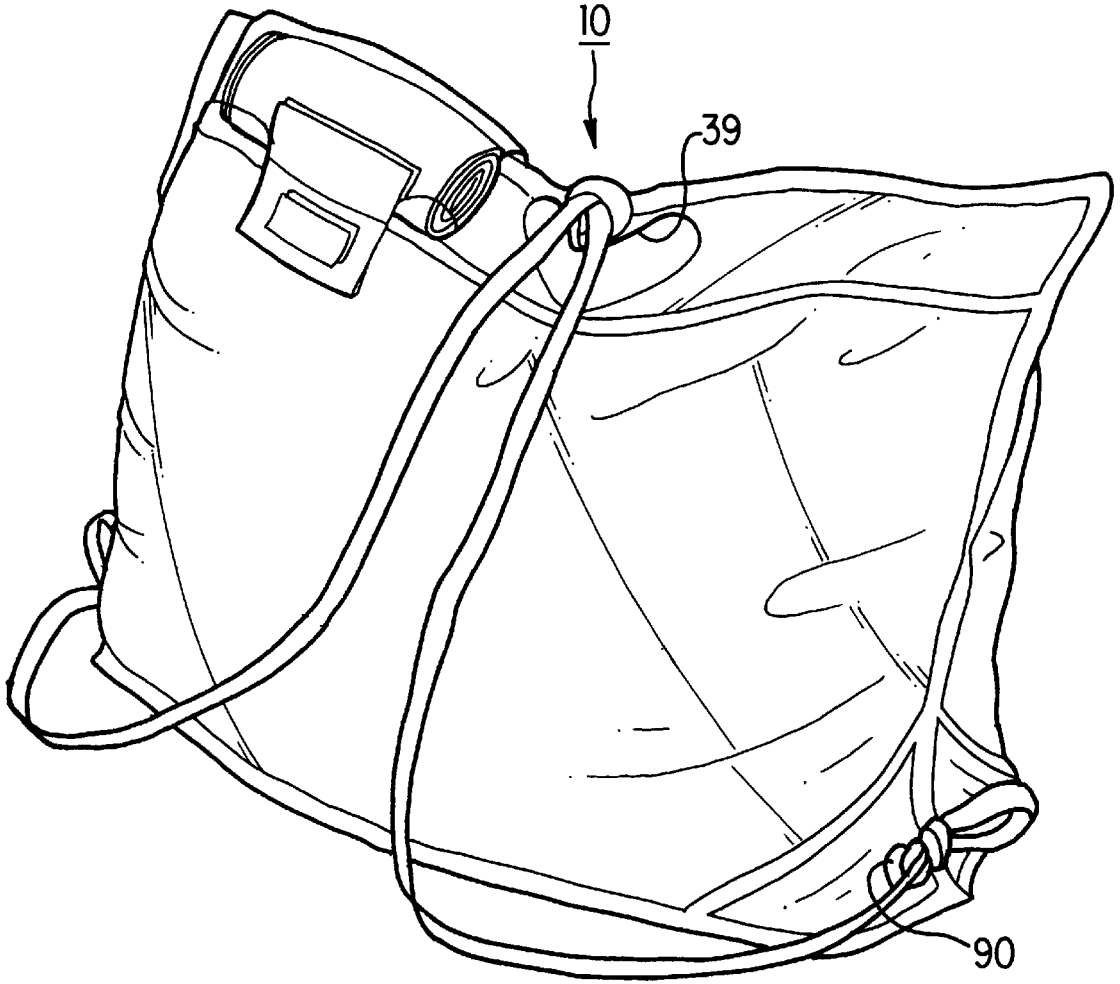
FIG. 20 is a perspective view showing a further embodiment of the invention.

FIG. 20 shows a further embodiment of the invention. In this case, the bag of the invention is adapted to be carried on the back like a knapsack. That is, the bag bottom is provided with holes 90, 90 on opposite sides (the left-hand side hole is not shown), and a rope is passed through a carrying hole 39 and the two bottom holes 90, 90.

Referring to FIGS. 21 through 33, other examples of the means for retaining show a lid 44*d* which covers the pocket 42 will be described. In addition, in the figures, the lid 44*d* is shown semielliptic, but it is not limited thereto and may be semicircular, rectangular, or triangular. Further, the lid 44*d* in any of the examples is formed with a hole 45 substantially in the center. The hole 45 comprises two round hole formations 45*a*, 45*a* vertically spaced a predetermined distance from each other, and a slit 45*b* vertically extending from the lower edge of the upper round hole formation 45*a* to the upper edge of the lower round hole formation 45*a*, but it is not limited thereto and may be a simple round hole or an elongated opening.

Figure 21:
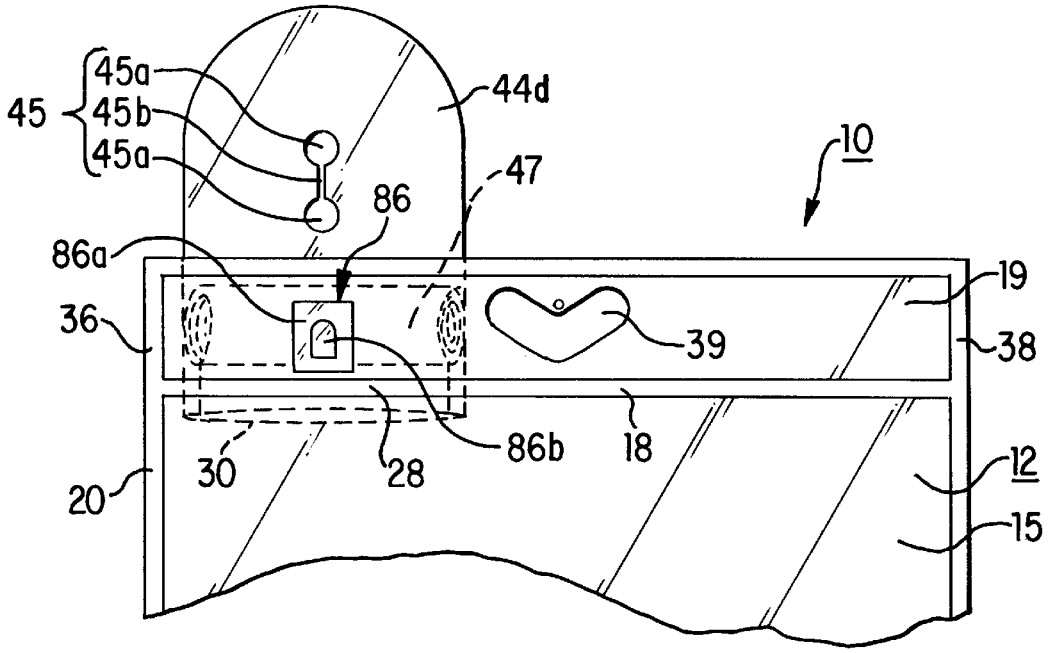
FIG. 21 is a perspective view showing a further embodiment of the present invention.
Figure 22:
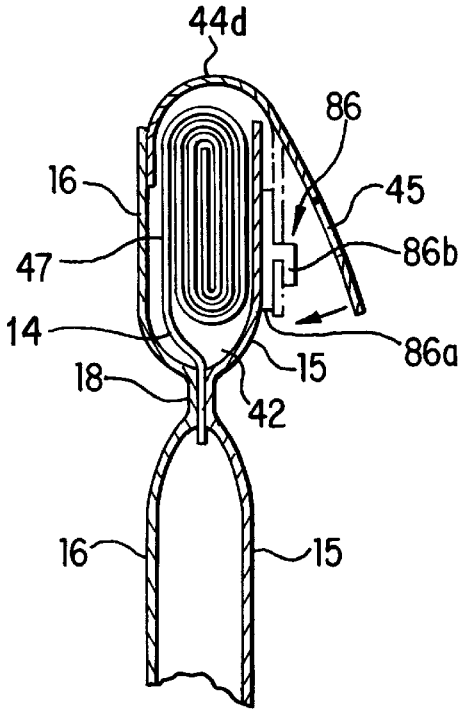
FIG. 22 is a longitudinal sectional view of the embodiment of FIG. 21.

As shown in FIG. 21, the outer surface of the sheet 15, opposed to the folded body 47, has a locking member 86 stuck thereto. This locking member 86, as shown in FIG. 22, comprises a quadrangular base plate 86*a*, and a locking portion 86*b* projecting from a central portion of the base plate 86*a* and bent downward. As shown in FIG. 22, the lid 44*d* covers the pocket 42, with the round hole formation 45*a* in the lid 44*d* engaging the locking portion 86*b* of the locking member 86. Thereby, the lid 44*d* is firmly maintained in a closed state (see the phantom line in FIG. 22).

Figure 23:
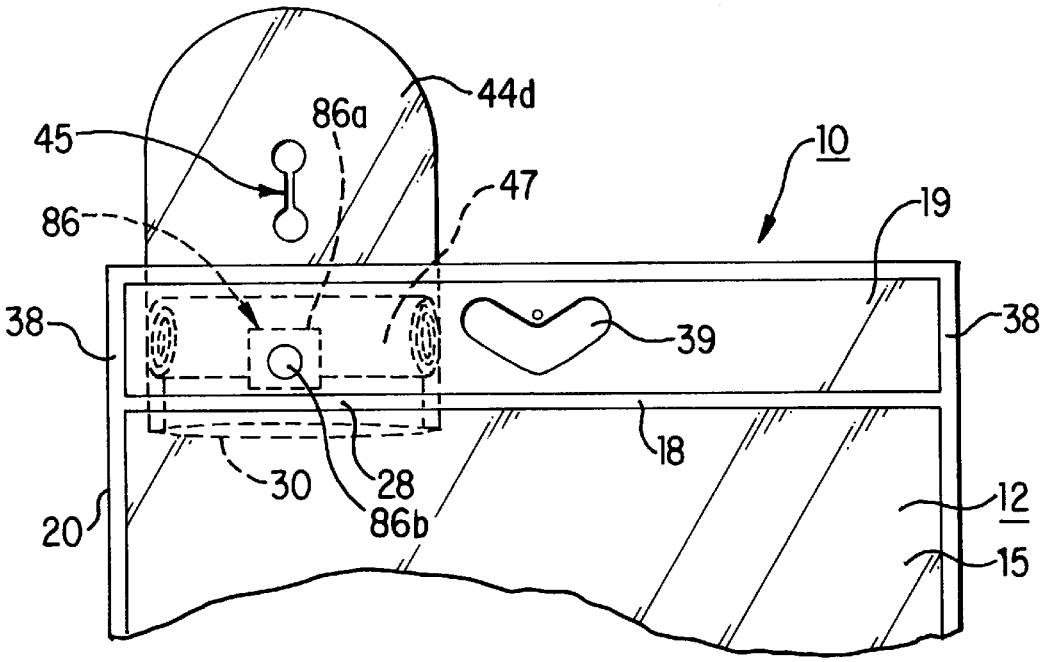
FIG. 23 is a perspective view showing a further embodiment of the present invention.
Figure 24:
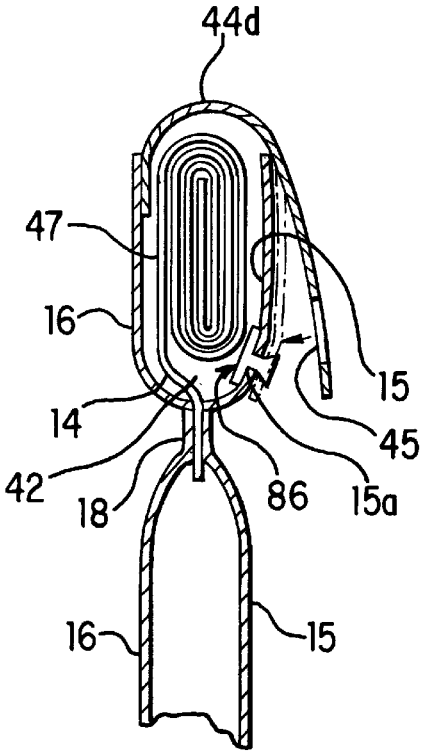
FIG. 24 is a longitudinal sectional view of the embodiment of FIG. 23.

As shown in FIG. 23, it is also possible to receive part of the locking member 86 in the pocket 42. That is, the locking member 86 in this embodiment, as shown in FIG. 24, comprises a quadrangular base plate 86*a*, and an inverted conical locking portion 86*b* projecting, with a gradually increasing diameter, from the center of the base plate 86*a*. The region of the sheet 15 opposed to the folded body 47 is formed with a round hole 15*a*. With the base plate 86*a* received in the pocket 42, the locking portion 86*b* is inserted in the round hole 15*a*. The locking portion 86*b* projects out through the round hole 15*a* and is inserted in the round hole formation 45*a* of the round hole 45. Thereby, the lid 44*d* is firmly maintained in a closed state. Since the locking portion 86*a* gradually increases in diameter toward its projecting end (free end), as described above, the lid 44*d* will not slip out with ease.

Figure 25:
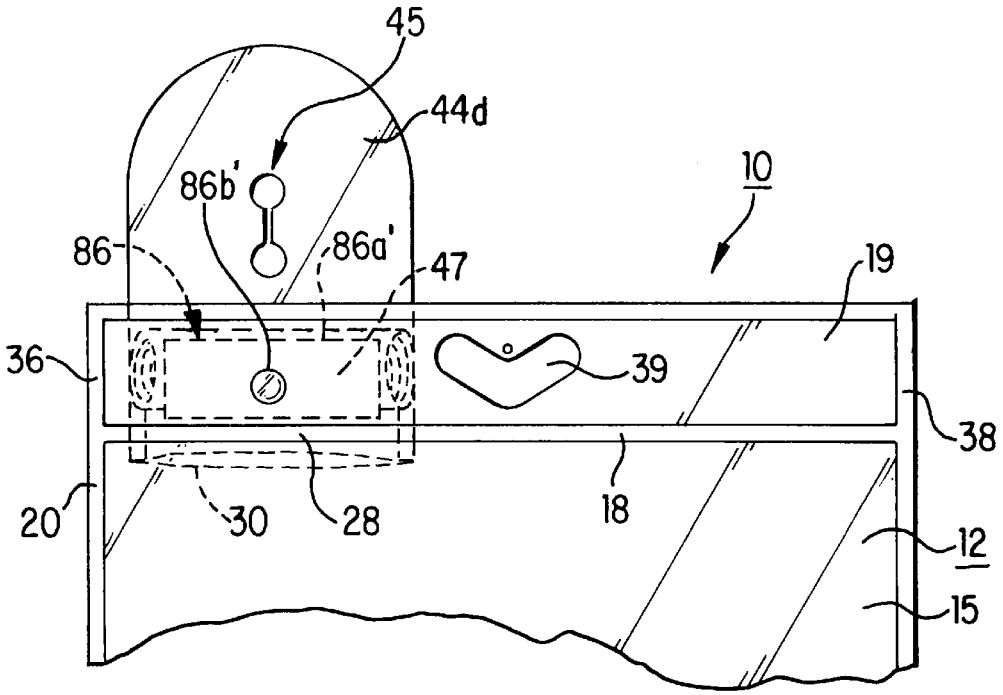
FIG. 25 is a perspective view showing a further embodiment of the present invention.
Figure 26:
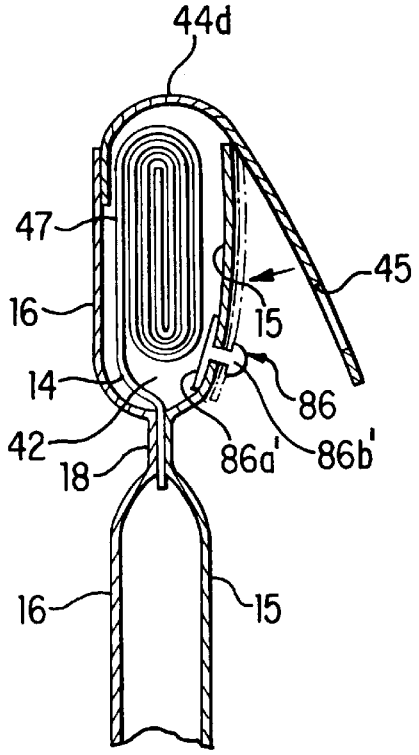
FIG. 26 is a longitudinal sectional view of the embodiment of FIG. 25.

An embodiment shown in FIGS. 25 and 26 is a modification of the embodiment shown in FIGS. 23 and 24. A base plate 86*a*' of the locking member 86 in this embodiment is larger than the base plate 86*a* in the above embodiment. Thereby, the movement of the locking member 86 in the pocket 42 is controlled. Further, a front end of a locking member 86*b*' is hemispherical. This facilitates insertion of the locking portion 86*b*' into the hole 45 in the lid 44*d*.

Figure 27:
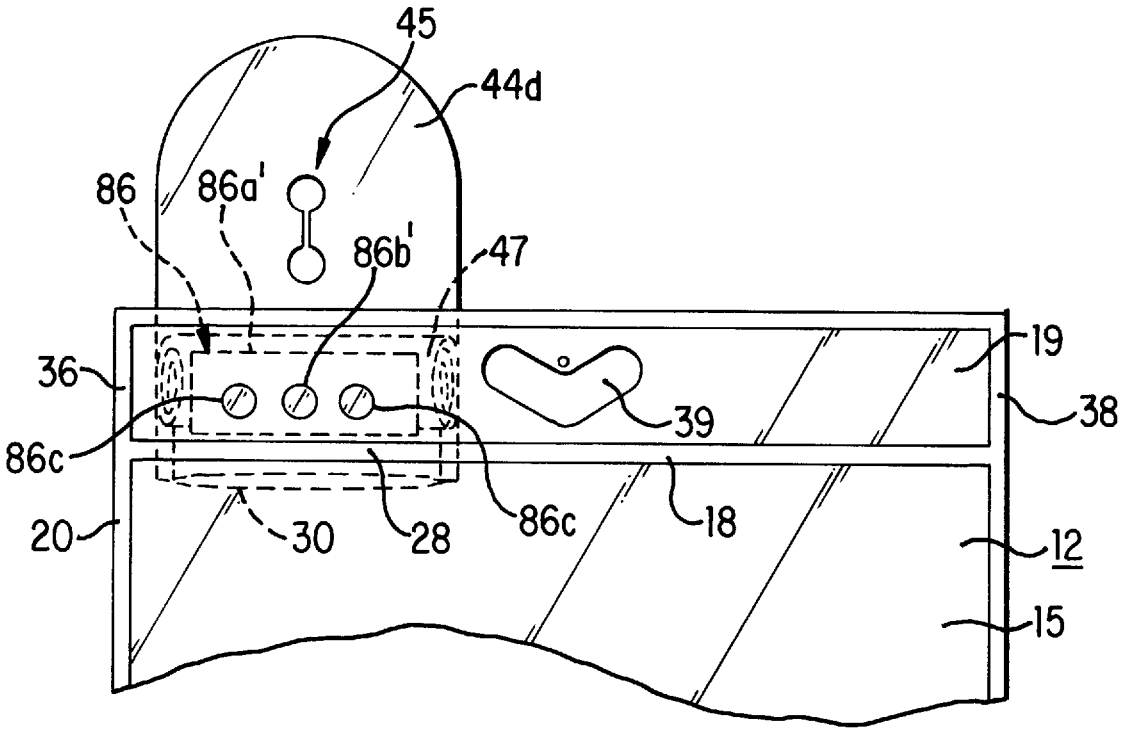
FIG. 27 is a perspective view showing a further embodiment of the present invention.
Figure 28:
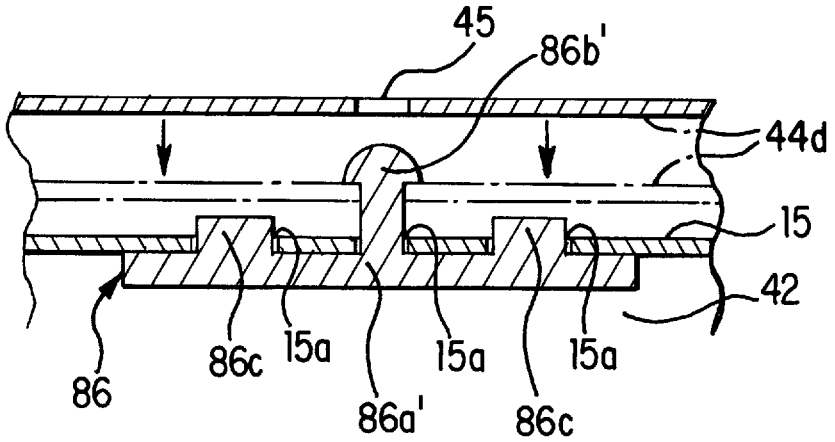
FIG. 28 is a cross section of the embodiment of FIG. 27.

An embodiment shown in FIGS. 27 and 28 is capable of more effectively controlling the movement of the locking member 86 in the pocket 42. That is, three round holes 15*a*, 15*a*, 15*a* are formed in a transverse row in the sheet 15 opposed thereto, while on the base plate 86*a* on the locking member 86, as clearly shown in FIG. 28, there is provided in the center the circular cylindrical locking portion 86*b*' having a hemispherical front end and there are provided cylindrical convex portions 86*c*, 86*c* on opposite-sides of the locking portion 86*b*'. The locking portion 86*b*' is inserted in the central round hole 15*a* in the sheet 15, while the convex portions 86*c* are inserted in the right and left round holes 15*a*, 15*a*. This provides more effective control over the movement of the locking member 86 in the pocket 42. Further, as in the case of the above, since the front end of the locking portion 86*b*' is hemispherical, insertion of the locking portion 86*b*' in the hole 45 in the lid 44*d* is facilitated.

Figure 29:
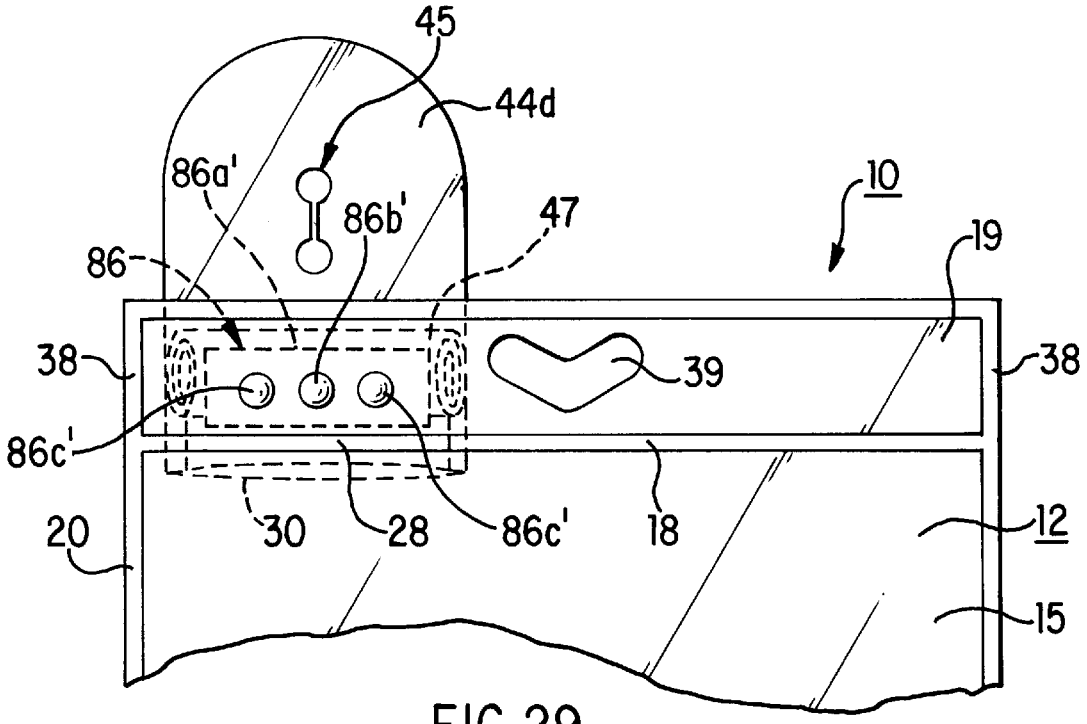
FIG. 29 is a perspective view showing a further embodiment of the present invention.
Figure 30:
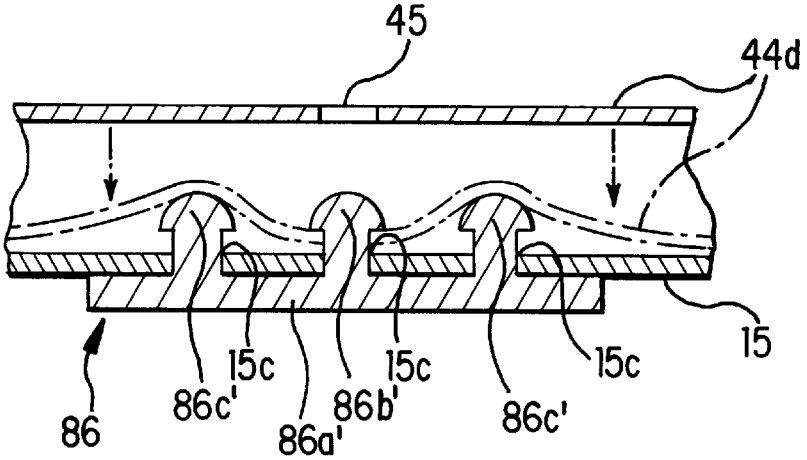
FIG. 30 is a cross section of the embodiment of FIG. 29.
Figure 31:
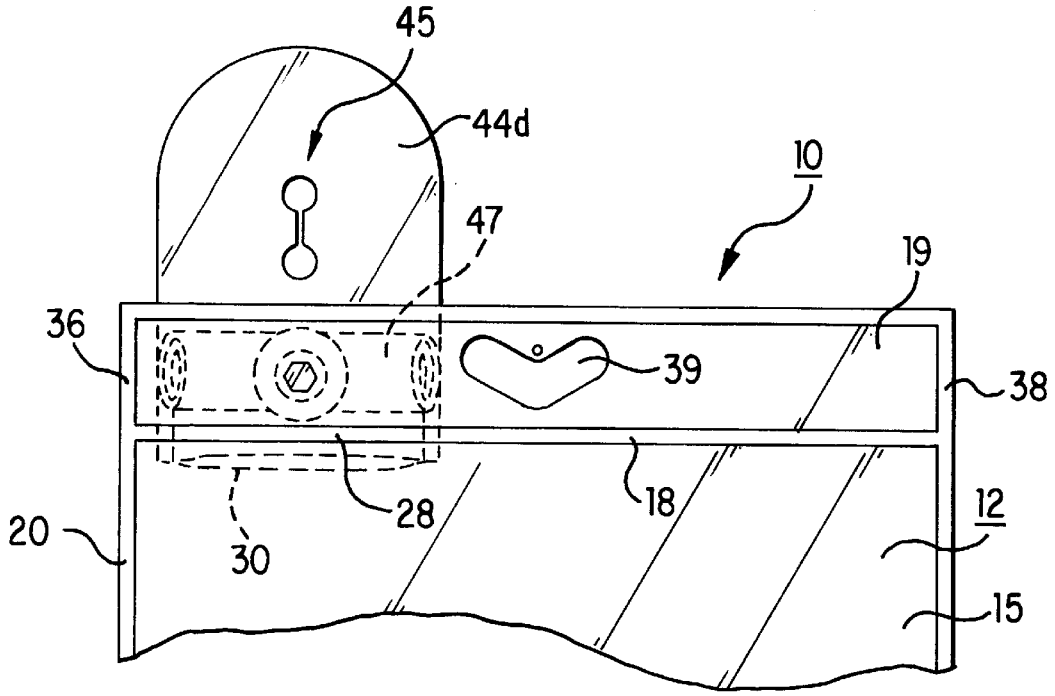
FIG. 31 is a perspective view showing a further embodiment of the present invention.
Figure 32:
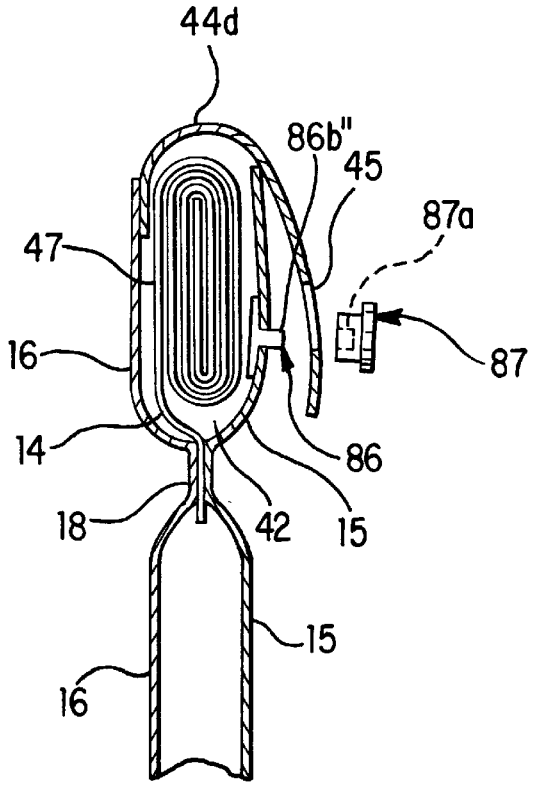
FIG. 32 is a longitudinal sectional view of the embodiment of FIG. 31.
Figure 33:
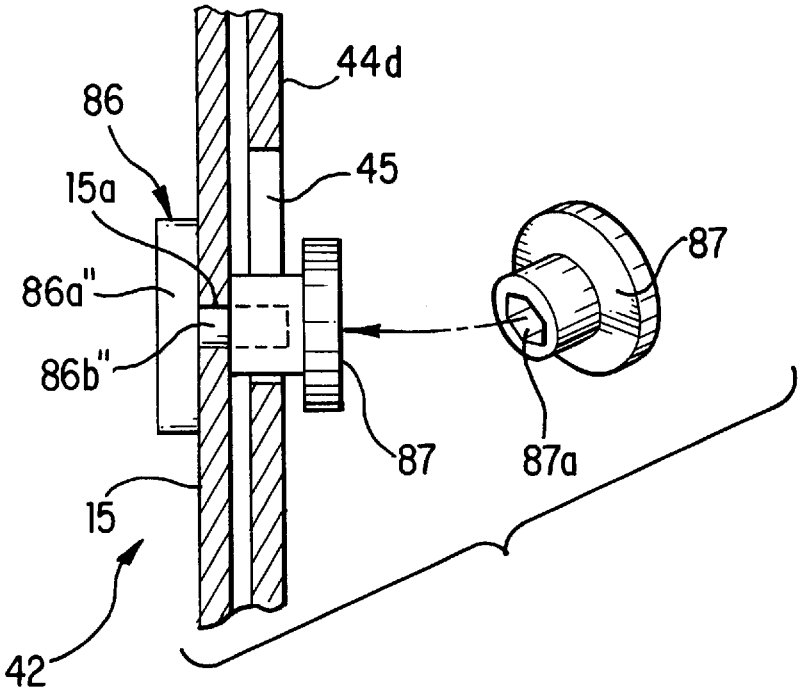
FIG. 33 is an enlarged view of FIG. 32.

An embodiment shown in FIGS. 29 and 30 is an example in which convex portions 86*c*', 86*c*' in the above embodiment are the same form as the lacking portion 86*b*', that is, the convex portions 86*c*', 86*c*' have hemispherical front end. In this case, it is possible to open holes in the lid 44*d*, which holes accommodate the convex portions 86*c*, 86*c*. An embodiment shown in FIGS. 31 through 33 is an example in which a cap 87 is attached to the front end of the locking portion 86*b*" in the locking member 86. More specifically, the locking member 86 in this embodiment comprises a base plate 86*a*" in the form of a circular plate, and a locking portion 86*b*" in the form of a hexagonal prism projecting from the central region of the base plate 86*a*". The portion of the sheet 15 opposed to the folded body 47 is formed with a round hole 15*a*, and the locking portion 86*b*" is inserted in the round hole 15*a* with the base plate 86*a*" received in the pocket 42. The locking portion 86*b*" projects through 44*d* the round hole 15*a* is inserted in the hole 45 in the lid 44*d*. The cap 87 has a hexagonal recess 87*a* and is fitted on a front end of the hexagonal prismatic locking portion 86*b*" (see FIGS. 32 and 33). In addition, in this embodiment, the locking portion 86*b*" may be in the form of an externally threaded circular cylinder, while the recess 87*a* of the locking portion may be a cylindrical recess having an internal thread cut therein adapted to engage with the external thread, so that the cap 87 is thereadedly fitted on the locking portion 86*b*".

In each of the above embodiments, the inlet-outlet spout 14 is folded and stored in the pocket 42 as follows. That is, the inlet-outlet spout 14 is longitudinally folded in two, the resulting folded body being then folded in two in the same direction, the resulting folded body being again folded in two into a small size and stored in the pocket 42.

In the bag of this invention, leakage of liquid or the like which is the content is reliably prevented by a simple construction. If it is arranged that the inlet-outlet spout can be held in its straightened and squeezed state, the thin stream delivery of the liquid or the like which is the content is possible and the delivery of the content can be temporarily cut by adjusting the squeezing degree.

What is claimed is:

1. A bag comprising:

a front sheet and a back sheet, each having peripheries aligned with and sealed to one another throughout the peripheries except at an unsealed periphery segment, said front sheet and said back sheet defining a bag interior therebetween;

a inlet-outlet spout formed of flexible tubular sheet material having a tubular construction defining a spout passage, said inlet-outlet spout having a base end sealed to said peripheries at said unsealed periphery segment to permit communication with said bag interior via said spout passage;

a pocket disposed at said base end of said inlet-outlet spout and having a pocket opening, said inlet-outlet spout being flattenable and foldable and said pocket being adapted to receive said inlet-outlet spout through said pocket opening with said inlet-outlet spout in a flattened and axially folded state;

a lid member formed of a flexible sheet material and disposed to be displaceable between a covering position covering said pocket opening and an open position permitting said inlet-outlet spout to be removed from said pocket and extended, and said lid member having opposite side surfaces;

fastening means for disengageably maintaining said lid member in said covering position to retain said inlet-outlet spout in said pocket in said flattened and axially folded state; and said lid member including restriction means for restricting said spout passage to restrict fluid flow therethrough by constricting said inlet-outlet spout such that expansion of said tubular sheet material to a maximum diameter of said tubular sheet material by fluid flow therethrough is prevented.

2. A bag comprising:

a front sheet and a back sheet, each having peripheries aligned with and sealed to one another throughout the peripheries except at an unsealed periphery segment, said front sheet and said back sheet defining a bag interior therebetween;

a inlet-outlet spout formed of flexible tubular sheet material having a tubular construction defining a spout passage, said inlet-outlet spout having a base end sealed to said peripheries at said unsealed periphery segment to permit communication with said bag interior via said spout passage;

a pocket disposed at said base end of said inlet-outlet spout and having a pocket opening, said inlet-outlet spout being flattenable and foldable and said pocket being adapted to receive said inlet-outlet spout through said pocket opening with said inlet-outlet spout in a flattened and axially folded state:

a lid member formed of a flexible sheet material and disposed to be displaceable between a covering position covering said pocket opening and an open position permitting said inlet-outlet spout to be removed from said pocket and extended, and said lid member having opposite side surfaces, fastening means for disengageably maintaining said lid member in said covering position to retain said inlet-outlet spout in said pocket in said flattened and axially folded state;

said lid member including restriction means for restricting said spout passage to restrict fluid flow therethrough by constricting said inlet-outlet spout such that expansion of said tubular sheet material to a maximum diameter of said tubular sheet material by fluid flow therethrough is prevented; and said restriction means including a pair of engaging means disposed on said opposite side surfaces of said lid member at positions permitting said pair of engaging means to engage one another when said lid member is displaced from said open position to a wrapped state, wherein said lid member is wrapped around said inlet-outlet spout, and to hold said lid member in said wrapped state such that said inlet-outlet spout is constricted to prevent expansion of said tubular sheet material to said maximum diameter.

3. A bag comprising:

a front sheet and a back sheet, each having peripheries aligned with and sealed to one another throughout the peripheries except at an unsealed periphery segment, said front sheet and said back sheet defining a bag interior therebetween;

a inlet-outlet spout formed of flexible tubular sheet material having a tubular construction defining a spout passage, said inlet-outlet spout having a base end sealed to said peripheries at said unsealed periphery segment to permit communication with said bag interior via said spout passage;

a pocket disposed at said base end of said inlet-outlet spout and having a pocket opening, said inlet-outlet spout being flattenable and foldable and said pocket being adapted to receive said inlet-outlet spout through said pocket opening with said inlet-outlet spout in a flattened and axially folded state;

a lid member formed of a flexible sheet material and disposed to be displaceable between a covering position covering said pocket opening and an open position permitting said inlet-outlet spout to be removed from said pocket and extended, and said lid member having opposite side surfaces;

fastening means for disengageably maintaining said lid member in said covering position to retain said inlet-outlet spout in said pocket in said flattened and axially folded state;

said lid member including restriction means for restricting said spout passage to restrict fluid flow therethrough by constricting said inlet-outlet spout such that expansion of said tubular sheet material to a maximum diameter of said tubular sheet material by fluid flow therethrough is prevented; and said restriction means is a receiving port formed in said lid member at a position permitting said inlet-outlet spout to be passed therethrough when said lid member is in said open position, said receiving port being dimensioned to prevent said expansion of said tubular sheet material to said maximum diameter of said tubular sheet material by fluid flow therethrough.

* * * * *